US008556649B2

(12) United States Patent
Nolting et al.

(10) Patent No.: US 8,556,649 B2
(45) Date of Patent: Oct. 15, 2013

(54) FIXING DEVICE FOR FIXING A CABLE AT A HOUSING FEED-THROUGH

(75) Inventors: Reinhard Nolting, Detmold (DE); Sven Elsaesser, Detmold (DE); Bernd Kueppers, Detmold (DE); Mattias Boensch, Bielefeld (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 180 days.

(21) Appl. No.: 13/141,976

(22) PCT Filed: Jan. 12, 2010

(86) PCT No.: PCT/EP2010/050291

§ 371 (c)(1),
(2), (4) Date: Jul. 8, 2011

(87) PCT Pub. No.: WO2010/084056

PCT Pub. Date: Jul. 29, 2010

(65) Prior Publication Data

US 2011/0315442 A1 Dec. 29, 2011

(30) Foreign Application Priority Data

Jan. 23, 2009 (DE) ..... 20 2009 000 899 U

(51) Int. Cl.
*H01R 13/58* (2006.01)

(52) U.S. Cl.
USPC ..... 439/455

(58) Field of Classification Search
USPC ..... 439/455
See application file for complete search history.

(56) References Cited

U.S. PATENT DOCUMENTS

| | | | | |
|---|---|---|---|---|
| 2,800,636 | A * | 7/1957 | Schnettler | 439/447 |
| 3,238,493 | A * | 3/1966 | Healy | 439/455 |
| 3,317,884 | A * | 5/1967 | Lynch | 439/455 |
| 3,526,871 | A | 9/1970 | Hobart | |
| 4,460,232 | A | 7/1984 | Sotolongo | |
| 5,315,684 | A | 5/1994 | Szegda | |
| 5,354,213 | A | 10/1994 | Hoffman | |
| 6,106,325 | A * | 8/2000 | Kuo | 439/455 |
| 6,206,714 | B1 | 3/2001 | Bernardini | |
| 6,257,920 | B1 * | 7/2001 | Finona et al. | 439/455 |
| 7,040,916 | B2 * | 5/2006 | Schmidt et al. | 439/460 |
| 7,163,408 | B1 * | 1/2007 | Chen et al. | 439/76.1 |
| 7,901,239 | B2 * | 3/2011 | Weber | 439/455 |
| 7,955,121 | B2 * | 6/2011 | Sattazahn et al. | 439/471 |
| 8,113,869 | B2 * | 2/2012 | Su et al. | 439/455 |
| 2003/0003796 | A1 * | 1/2003 | Zoiss | 439/455 |

FOREIGN PATENT DOCUMENTS

| | | | |
|---|---|---|---|
| DE | 202005059 | U1 | 7/2002 |
| DE | 20217501 | U1 | 3/2003 |
| DE | 202004005878 | U1 | 10/2005 |
| DE | 102006007604 | A1 | 8/2007 |
| DE | 60129205 | T2 | 3/2008 |
| DE | 202007005126 | U1 | 8/2008 |

* cited by examiner

*Primary Examiner* — Gary F. Paumen
(74) *Attorney, Agent, or Firm* — Lawrence E. Laubscher, Sr.; Laurence E. Laubscher, Jr.

(57) ABSTRACT

Conductor connecting apparatus for connecting with a housing an insulated conductor having a bare end portion from which the insulation layer has been removed, comprising a housing containing an access opening communicating with a chamber contained within the housing, an annular mounting ring adapted for mounting concentrically about the insulated layer of the conductor, a fastening device for fastening the mounting ring to the insulated layer of the conductor, and a connecting arrangement for connecting the mounting ring with the access opening such that the conductor bare end portion extends into said housing chamber.

12 Claims, 6 Drawing Sheets

FIXING DEVICE FOR FIXING A CABLE AT A HOUSING FEED-THROUGH

REFERENCE TO RELATED APPLICATIONS

This application is a national stage application under 35 U.S.C. Section 271 of International Application No. PCT/EP2010/050291 filed Jan. 12, 2010, claiming priority of German Application No. 20 2009 000 899.1 filed Jan. 23, 2009.

BACKGROUND OF THE INVENTION

1. Field of the Invention

Conductor connecting apparatus for connecting with a housing an insulated conductor having a bare end portion from which the insulation layer has been removed, comprising a housing containing an access opening communicating with a chamber contained within the housing, an annular mounting ring adapted for mounting concentrically about the insulated layer of the conductor, a fastening device for fastening the mounting ring to the insulated layer of the conductor, and a connecting arrangement for connecting the mounting ring with the access opening such that the conductor bare end portion extends into said housing chamber.

2. Description of Related Art

Fixing device for fixing cables to a housing feed-through are known in various designs. A need for improvement exists particularly with a view to simplifying the handling as much as possible.

For the state of the art, the following are mentioned: DE 10 2006 007 604 A1, DE 20 2004 005 878 U1, DE 202 05 059 U1, DE 202 17 501 U1, DE 62 06 714 B1 and DE 209 29 205 T2.

SUMMARY OF THE INVENTION

Accordingly, a primary object of the invention is to provide a conductor connecting apparatus for connecting with a housing an insulated conductor having a bare end portion from which the insulation layer has been removed, comprising a housing containing an access opening communicating with a chamber contained within the housing, an annular mounting ring adapted for mounting concentrically about the insulated layer of the conductor, a fastening device for fastening the mounting ring to the insulated layer of the conductor; and a connecting arrangement for connecting the mounting ring with the access opening such that the conductor bare end portion extends into said housing chamber.

According to a more specific object of the invention, the housing includes a tubular access portion containing an access opening, and a bore dimensioned to receive the insulation layer when the conductor bare end is inserted into the housing chamber via the access opening. The housing access portion bore contains a counterbore, and the mounting ring includes a tubular body portion that extends into the counterbore when the mounting ring is connected with said housing. An annular seal member is arranged between the bottom wall of the counterbore and the end extremity of the locking ring body portion.

According to another object of the invention, the mounting ring includes an annular flange portion arranged at one end of the mounting ring body portion, and the mounting ring connecting means includes a pair of diametrically opposed locking arms extending from the mounting ring flange portion longitudinally on opposite sides of the housing access portion, and hook and projection means for locking the mounting ring against axial displacement relative to the housing.

According to a further object, the mounting ring fastening means includes an externally-threaded set screw mounted in a threaded radial bore contained in said mounting ring body portion, whereby said set screw is operable for locking engagement with the insulation layer of the conductor.

The invention creates a fastening device for insulated conductors or cables which have at least one conductor which is provided with at least one insulation layer, on a housing feed-through of a housing, where the fastening device presents a locking ring which can be fixed axially to the outer circumference of the cable, and where the locking ring is fixed on the housing in a locking manner.

According to the invention, a cable denotes a conductor which is enclosed by at least one layer of insulation. To the extent that more than one conductor is provided, each enclosed by an insulation, these conductors can be embedded in a supplemental cable jacket and/or enclosed by a cable shield.

A fastening device for housing access openings is produced, which is particularly easy to handle and nevertheless particularly reliable.

In a simple design for the fastening of the cable on the housing access opening in a locking manner, it is advantageous to design corresponding locking means on the locking ring and on the housing.

According to an additional preferred embodiment, the housing presents a feed-through channel which is designed for feeding the cable through same, and for receiving a ring attachment of the locking ring.

To be able to accommodate the ring attachment and optionally a seal in this feed-through channel, it is advantageous for the housing to have a housing attachment which is provided with a feed-through channel. In this way, the feed-through channel can have a greater length than the thickness of the housing wall outside of the housing attachment.

According to a preferred embodiment, the fixing device can also be designed with a sealing element of higher protection class, particularly a radially acting O-ring.

It is advantageous if the locking ring is provided with at least one fastening element for the axial attachment of the locking ring on the outer circumference of the cable. The cable feed-through is thus suitable for absorbing very large tensile forces.

According to a variant which has a particularly simple construction while being nonetheless particularly reliable operationally, the fastening element can be designed as a threaded pin which can be screwed into a radial threaded bore of the locking ring. In this connection, the cost effective design, with only a few elements, should also be emphasized. There is no need for a separate strain relief in addition to the threaded pin.

It should be noted that, instead of the threaded set screw as fixing element, other fixing elements can be provided, for example, commercial screws, a clamping and/or cutting fork which fixes the insulation by clamping same in a fixed position, or by slight incision at the radius, so that the clamping and/or cutting cable is fixed axially on the outer circumference of the conductor, where the clamping or cutting cable can be screwed radially into a corresponding recess on the locking ring.

In an embodiment of the connection devices as direct plug-in connection clamp (push-in), it is additionally possible that the connection of the conductor, and the fixing of the fixing ring on the housing feed-through or on the ring attachment occur in only a single work step. A simple and reliable installation in the field is thus made possible.

Furthermore, it should be noted that the conductor end can also be provided optionally with a clamp contact and/or different contact, which itself can then be inserted in a connection device. With a view to the connection device, it should be added, moreover, that the latter can also be a tension spring, particularly in the open position.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
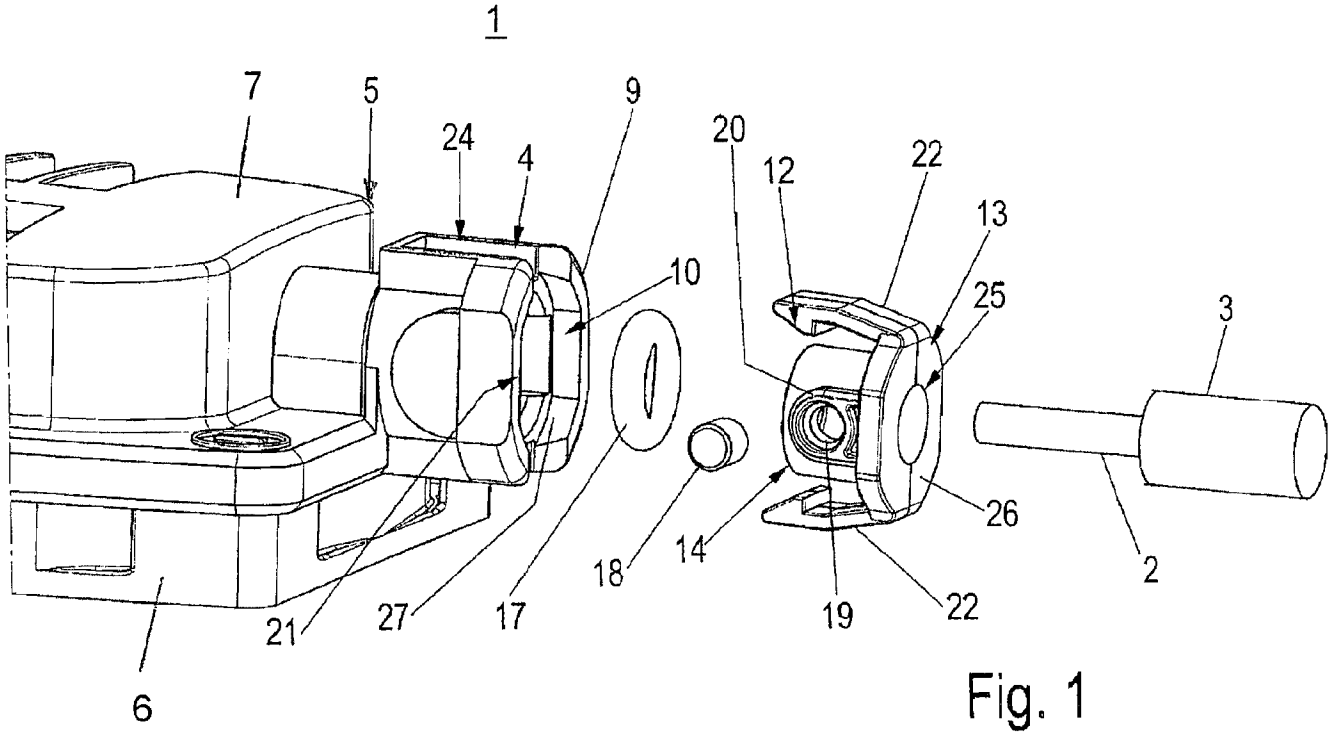
FIGS. 1-3 are exploded perspective views of the connecting apparatus of the present invention for connecting an insulated conductor with a housing.
Figure 2:
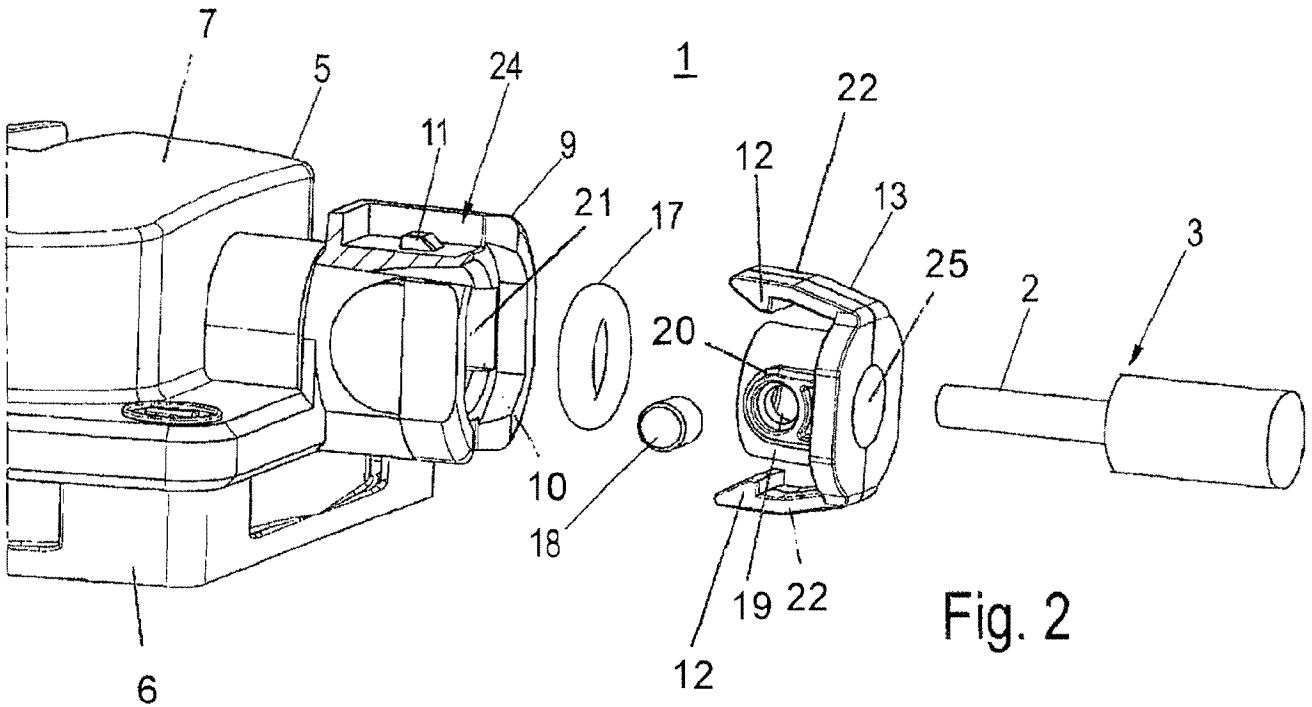
Figure 3:
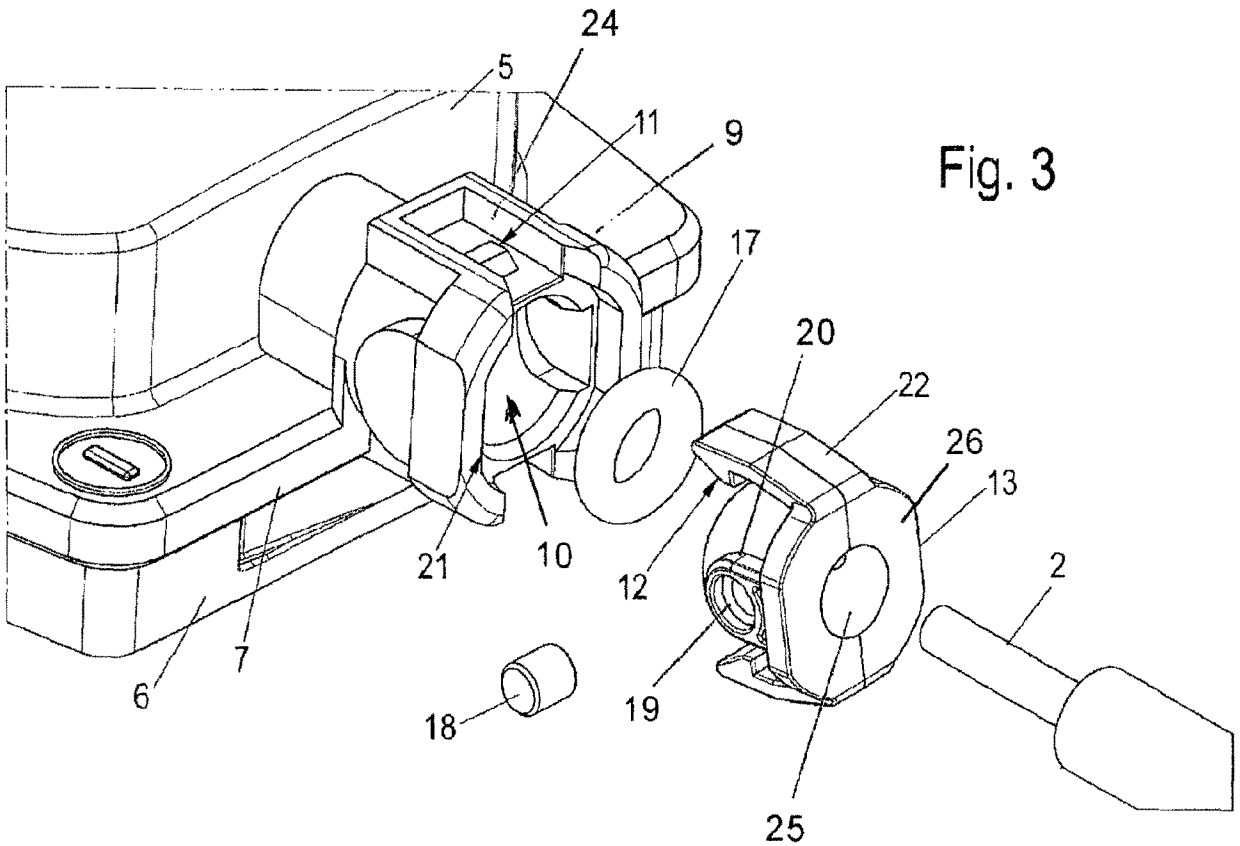

Referring first more particularly to FIGS. 1-3. the connector apparatus 1 of the present invention includes an annular locking or mounting ring 13 for connecting to a housing 5 a conductor 2 having an insulation layer 3. The locking ring includes a body portion 14 containing a longitudinal through bore 25 for receiving the conductor insulation layer 3, and a threaded transverse bore 19 for receiving a set screw 18 that is operable to fasten the locking ring to the insulation layer 3. An integral collar portion 20 surrounds the opening of the transverse bore 19. The length of the set screw 18 is such that the set screw is completely contained within the bore 19 and the collar 20 when the locking ring 13 is fastened to the insulated conductor. An O-ring seal 17 is arranged for mounting concentrically about the tubular body portion 14. The locking ring includes at its end remote from the housing a flange portion 26 from which longitudinally extend a pair of diametrically arranged resilient locking arms 22 having inwardly directed hooks 12 at their free ends.

The housing 5 includes a tubular access portion 9 containing an access passage 10 for receiving the body portion 14 of the locking ring 13, and an external surface containing a pair of diametrically arranged guide tracks 24 for receiving the arms 22 of the locking ring. Abutments 11 are provided in the guide tracks 24 for locking engagement with the hooks 12 on the locking arms, as will be described in greater detail below. The housing access portion 9 also contains a pocket or recess 21 for receiving the collar portion 20 on the body portion 14 of the locking ring.

Figure 4:
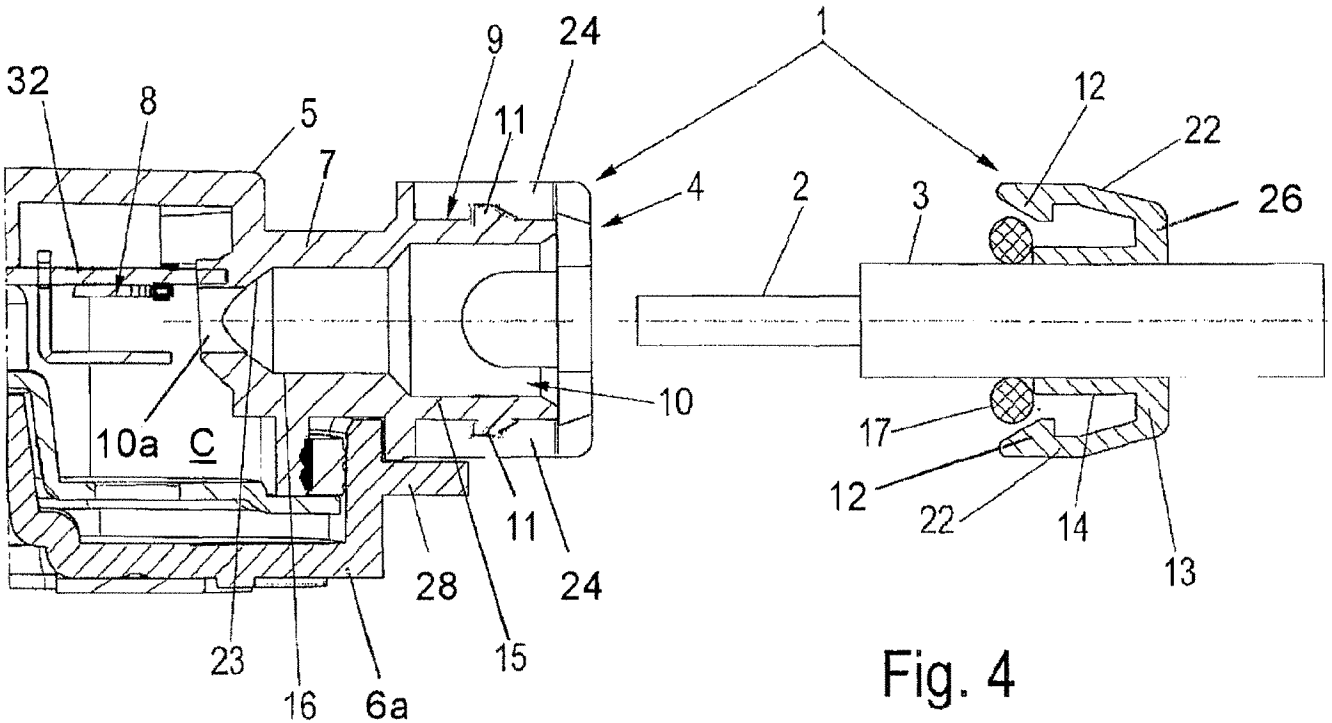
FIG. 4 is a detailed longitudinal sectional view of the disassembled apparatus of FIGS. 1-3.
Figure 5:
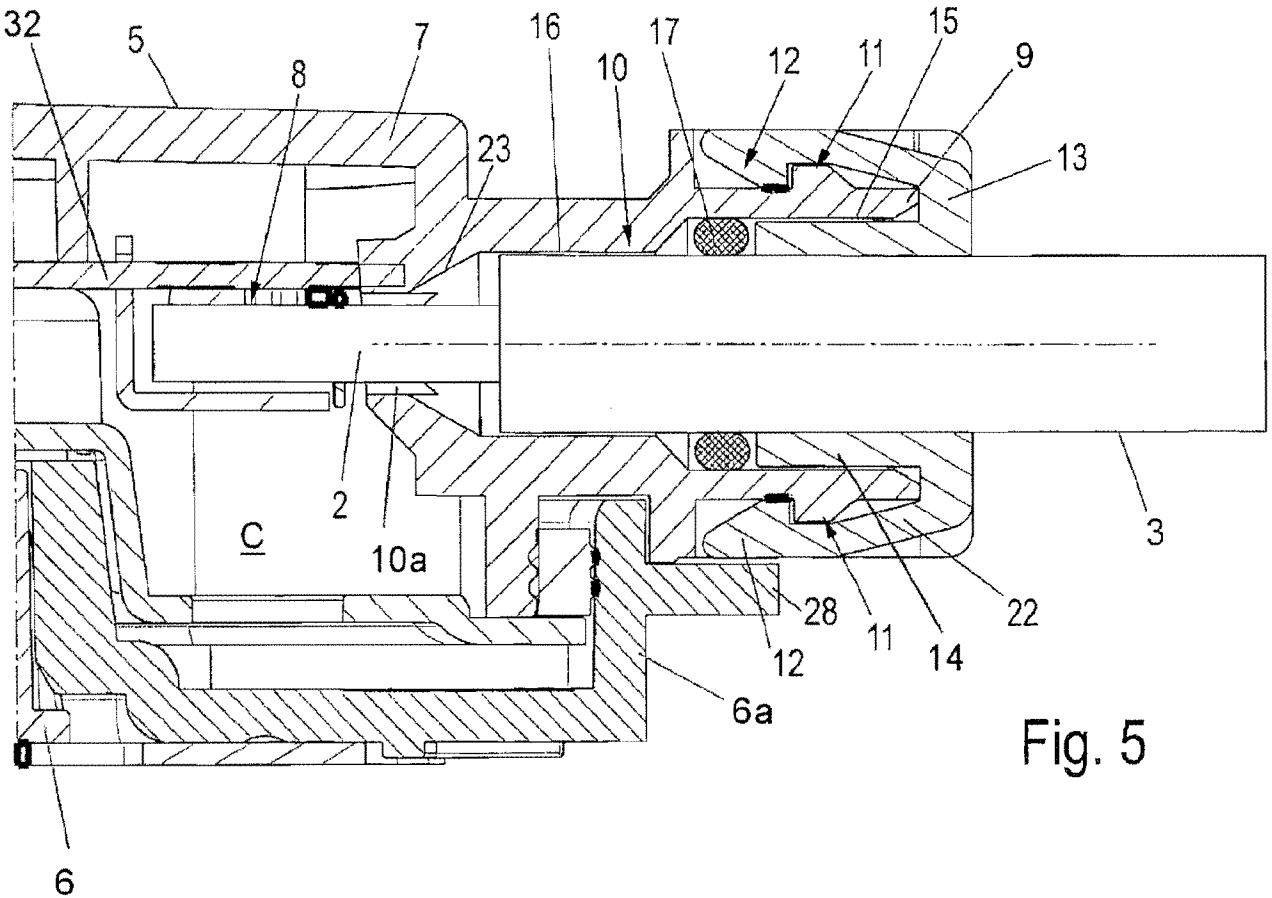
FIG. 5 is a detailed longitudinal sectional view of the apparatus of FIG. 4 in the assembled condition.

Referring now to FIGS. 4 and 5, the housing access passage 10 includes a bore 16 having a conical bottom wall 23 that contain an opening 10*a* in communication with the housing chamber C, and a counterbore 15. Assuming that the base section 6*a* is initially removed from the housing, as the insulated conductor 2 with the locking ring fastened thereto are axially displaced toward the housing to the assembled condition of FIG. 5, the end of the insulation layer 3 extends into the bore 16, and the stripped end portion of the conductor 2 extends through the opening 10*a* for engagement with the bus bar 32 mounted within housing chamber C. Clamping means 8, such as a leaf spring, bias the conductor into engagement with the bus bar. The O-ring 17 is compressed between the outer circumferential surface of the insulation layer 3 and the counterbore wall surface. The resilient locking arms 22 on the locking ring extend into guide tracks 24 on the housing attachment portion 9 until the hook portions 12 are in locked engagement with the projections 11 on the bottom walls of the guide tracks 24. The housing base section 6*a* is then fastened to the housing such that the extension portion 28 of the base section extend across one of the locking arms, thereby to prevent unlocking of the hook 12 from the locking projection 11.

Figure 6:
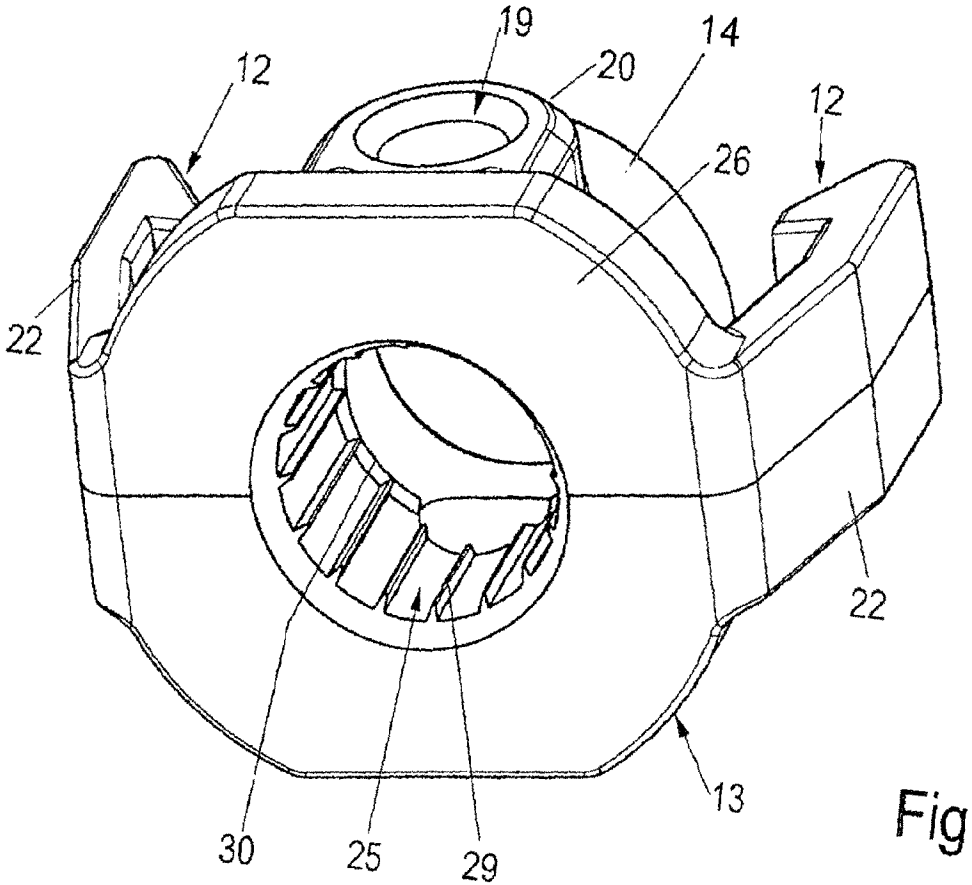
FIG. 6 is a perspective end view of the locking ring of FIGS. 1-3.

As shown in FIG. 6, the inner wall surface of the through bore 25 contained in the locking ring 13 is provided with a plurality of longitudinal grooves 29 that define ledges 30, such that when the set screw is tightened to fasten the locking ring to the insulated conductor, the insulation layer 3 is deformed by the grooves and ledges, thereby serving as strain relief means for the insulated conductor.

The fixing device 1 is in principle also suitable for fixing multiple conductor cables (not shown here). The housing 5 is designed particularly preferred embodiment as a connection box for the connection of conductors to conductors (not shown here) of a solar panel. In a preferred embodiment of the housing 5 as connection box for solar panels, the housing 5 contains a connection for connecting conductor ends to solar panels (not shown here), and the housing 5 is fixed to the solar panel.

The housing 5 serves, furthermore, to receive electrical or electronic components, particularly diodes. Furthermore, it is used for connecting the conductor 2 to the solar panel. For this purpose, connection devices 8 are arranged in the housing 5, which are designed as connection clamps, in a preferred embodiment. The connection clamps can be particularly screw clamps or spring clamps; however, they can also be designed using a different connection technology. It is particularly preferred to use so-called pressure spring clamps with the direct plug-in technology (push-in), which are designed in such a way that the inserted conductor 2 displaces a clamp spring as it is introduced, pressing the inserted conductor 2 against a current bar 3, so that a conducting contact is established. Such push-in contacts which are particularly suitable for a quick connection requiring no tools are known in themselves, and thus not described further here.

An electrical contact is established by inserting the conductor 2 into the connection device 8, and contacting the conductor 2 with the connection devices 8. Here it is necessary to lead the conductor 2 with the insulation 3 through the housing feed-through 4, and fix it in this area axially for strain relief. It is particularly preferred here to produce a sealed housing feed-through 4 having a relatively high protection type, so that the housing 5 can be used on solar panels, even outdoors. The locking means 11 and 12 are designed preferably as locking hooks which can be engaged with each other by assembly. The locking device can be designed in such a way that it can be opened again (multiple locking) or cannot be opened again (one-time locking).

The locking ring 13 presents a substantially cylindrical ring attachment 14, which is designed in such a way that it can be plugged in a corresponding first inner section 15 of the housing attachment 9. The locking ring presents furthermore a cable feed-through channel 25 which passes axially through same, and a flange section 26 which, in the mounted state, closes off the attachment 9 at the free end to a large extent, and through which the cable passes.

The feed-through channel 10 is designed as a housing wall break-through. It presents a stepped contour. towards the outside, the first inner section 15 of larger inner diameter is provided, which is followed by a second inner section 16 of smaller inner diameter towards the housing interior, whose circumference corresponds substantially to the outer circumference of the cable to be connected, in this case the conductor 2 with the insulation 3.

The inner section 15, on the other hand, presents an inner diameter which corresponds to the outer diameter of the ring attachment 14 of the locking ring 13, where the inner diameter of the locking ring 13 is adapted to the outer diameter of the cable, that is, the conductor 2 with the insulation 3.

It is preferred to arrange a sealing element between the axial end—facing the housing interior—of the ring attachment 14 of the locking ring 13, and the stepping between the inner sections 15 and 16 of the feed-through channel 10. This sealing element is designed preferably as a sealing ring 17.

In particular, as sealing ring, an O ring or a gasket is used, which is designed in such a manner that its cross section is slightly larger than the radial separation between the outer diameter of the conductor insulation 3 and the inner circumference of the inner section 15 of the feed-through channel 10. This seal can also be omitted, and sealing can be achieved by interference fit. This is sealed by the ring 13, which is pressed into the housing, by means of plastic (particularly in case of lower sealing classes).

In this way, the sealing ring has a radial sealing action, which results in an excellent sealing effect on the housing feed-through 4.

The transition between the inner sections 15 and 16 can present a conical design. Furthermore, it is conceivable that the internal inner section 16 of the feed-through channel 10 is followed by an additional conical inner section 23, which forms a kind of introduction funnel for introducing the conductor 2 into the connection device 8.

On the outer axial end, the feed-through channel can also have an area 27 with still larger diameter (optionally with a polygonal inner contour), into which the flange-like axial end 26 of the locking ring 13 can be introduced.

In this connection it should be noted that the conductor end, in an embodiment of the connection device 8 as a push-in clamp, is insulated at its free end.

The locking ring 13 is slipped prior to the installation on the free cable end (see FIG. 4), and fixed without possibility of movement, in the predetermined axial position on the cable end.

In the area of the threaded bore 19, the ring attachment 14 can be provided furthermore with a radial projection 20. This radial projection 20 is designed to be moved into a corresponding reception pocket 21 in the feed-through channel 10. As a result, it is ensured that, after the installation, the threaded pin 18 cannot rotate radially out of the threaded bore.

The locking hooks 12 on the locking ring 13 are formed on one or more, preferably on two resilient locking arms 22 which extend radially outside of the outer circumference of the ring attachment 14 parallel to the latter, where the locking arms 22 are arranged radially at some separation from the ring attachment 14, so that they can engage over the housing attachment 9 of the outer circumference. The locking hooks 11 are arranged on the outer circumference of the housing attachment 9, preferably in radially extending reception guides 24 for the locking arms 22, which are also preferably diametrically opposite, like the locking arms.

The insertion of the cable with the conductor 2 and the conductor insulation 3 into the ring attachment 14 occurs until the locking hooks 12 snap in behind the locking abutments 11 of the ring attachment 14. In this state, the cable is fixed with seal on the housing cover. Then, the housing cover is placed on the housing lower part. As can be seen in FIG. 5, the housing lower part **6*a* can be designed here in such a way that it (preferably with a ledge 28) covers or advantageously secures one locking hook 12 (in FIG. 5, the bottom locking hook), in such a way that it can no longer become detached from the locking to the corresponding locking hook 11 on the housing 5 (here on the housing upper part 7**).

While the locking hooks, according to the enclosed figures, are arranged radially towards the interior on the locking arms 22, they can also be oriented differently according to alternative designs. Thus, the locking hooks can point outward, or locking clasps could be formed, that is, a divided locking arm, where, on the locking arm ends, two locking hook arrangements (not shown here) are provided which point away from each other FIG. 6 shows that, on the inner circumference of the cable feed-through channel 25 of the locking ring 13, advantageously at least one or more axial ledges 29 and/or at least one or more peripheral ledges 30 can be formed. This has, on the one hand, the advantage that the material of the insulation of the cable, when the threaded pin 18 is tightened, presses into the space between the axial ledges 29, so that the locking ring 13 and the cable are secured relative to each other in a simple way, even against relative twisting, and, on the other hand, the advantage that the peripheral ledge 30 additionally protects the cable against axial relative movements, with strain relief.

Finally, it should be noted that two, preferably mutually diametrically facing, radial bores 19 and projections 20 in/on the locking ring 13 provide the advantage that the fixation of the threaded pin 18 can occur in each case from the easiest accessible installation position. In addition, the insulation of the cable is pressed with fixing effect into the respective facing threaded bore 19 which remains empty.

In addition, the locking hooks do not necessarily have to be under preliminary tension according to the invention, to achieve a radial sealing, which has an advantageous effect on the service life.

The sealing effect in the area of the sealing ring 17 can optionally be increased further by a labyrinth-like design of the areas abutting the sealing ring.

While in accordance with the provisions of the Patent Statutes the preferred forms and embodiments of the invention have been illustrated and described, it will be apparent to those skilled in the art that changes may be made without deviating from the invention described above.

What is claimed is:

1. Conductor connecting apparatus for connecting with a housing an insulated conductor (3) having a bare end portion (2) from which the insulation layer has been removed, comprising:

(a) a housing (5) containing an access opening (10) communicating with a chamber (C) contained within said housing;

(b) an annular mounting ring (13) adapted for mounting concentrically about the insulated layer of the conductor;

(c) fastening means (18) for fastening said mounting ring to the insulated conductor; and (d) snap-on connecting means (11, 12) for connecting said mounting ring with said access opening such that the conductor bare end portion extends into said housing chamber, said snap-in connecting means including a plurality of resilient locking arms (22) that extend longitudinally from said mounting ring and which carry locking hook portions 12 arranged for locking engagement with corresponding locking abutments ((11) fixed to said housing.

2. Conductor connecting apparatus for connecting with a housing an insulated conductor (3) having a bare end portion (2) from which the insulation layer has been removed, comprising:

(a) a housing (5) containing an access opening (10) communicating with a chamber (C) contained within said housing;

(b) an annular mounting ring (13) adapted for mounting concentrically about the insulated layer of the conductor;

(c) fastening means (18) for fastening said mounting ring to the insulated conductor; and (d) connecting means (11, 12) for connecting said mounting ring with said access opening such that the conductor bare end portion extends into said housing chamber;

(e) said housing including a tubular access portion (9) containing said access opening, said tubular access portion containing a bore (16) dimensioned to receive the insulation layer when the conductor bare end is axially inserted longitudinally in one direction into said housing chamber via said access opening.

3. Conductor connecting apparatus as defined in claim 2, wherein said housing access portion bore contains a counterbore (15); and further wherein said mounting ring includes a tubular body portion (14) that extends into said counterbore when said mounting ring is connected with said housing.

4. Conductor connecting apparatus as defined in claim 3, wherein said mounting ring includes an annular flange portion (26) arranged at one end of said mounting ring body portion; and further wherein said connecting means includes:

(1) a pair of diametrically opposed locking arms (22) extending from said mounting ring flange portion longitudinally on opposite sides of said housing access portion; and (2) hook and projection means (12; 11) locking said mounting ring against axial displacement in the opposite longitudinal direction relative to said housing.

5. Conductor connecting apparatus as defined in claim 3, wherein said fastening means includes an externally-threaded set screw (18) mounted in a threaded radial bore (19) contained in said mounting ring body portion, whereby said set screw is operable for locking engagement with the insulation layer of the conductor.

6. Conductor connecting apparatus as defined in claim 5, wherein the length of said set screw is such that when said set screw is in locking engagement with the conductor insulation layer, said set screw is contained completely within said radial bore.

7. Conductor connecting apparatus as defined in claim 6, wherein said mounting ring body portion includes a raised collar portion (20) extending concentrically about said threaded radial bore; and further wherein said housing tubular access portion contains a pocket (21) for receiving said raised collar portion when said locking ring is fastened to said housing, thereby to protect said set screw against displacement or loss.

8. Conductor connecting apparatus as defined in claim 3, and further including an annular seal member (17) arranged between the bottom wall of said counterbore and the end extremity of said locking ring body portion.

9. Conductor connecting apparatus as defined in claim 8, wherein said seal member comprises an O-ring that is compressed between the counterbore side wall and the insulation layer of the conductor.

10. Conductor connecting apparatus as defined in claim 2, and further including a bus bar (32) extending into said housing chamber, and resilient clamping means (8) for connecting the bare free end of the conductor with said bus bar.

11. Conductor connecting apparatus as defined in claim 5, wherein said annular mounting ring contains a through bore (25) for receiving said insulated conductor, said through bore containing a plurality of longitudinal grooves (29) that define stepped portions (30) adapted to engage the conductor insulation layer, thereby to provide strain relief for the conductor when said set screw is in locking engagement with the conductor insulation layer.

12. Conductor connecting apparatus as defined in claim 4, wherein said housing includes a base (6), a cover section (7) cooperating with said base to define said chamber, and a base section (**6*a*) having an extension portion (28**) that extends over one of said locking arms when said mounting ring is connected with said housing, thereby to lock said one locking arm to said housing.

* * * * *